US010661973B1

(12) United States Patent
Caruso

(10) Patent No.: US 10,661,973 B1
(45) Date of Patent: May 26, 2020

(54) AEROSOL CANISTER CARE WITH LOCKING TWIST CAP

(71) Applicant: Avanti USA Ltd., Tonawanda, NY (US)

(72) Inventor: Albert P. Caruso, Tonawanda, NY (US)

( * ) Notice: Subject to any disclaimer, the term of this patent is extended or adjusted under 35 U.S.C. 154(b) by 0 days.

(21) Appl. No.: 16/199,413

(22) Filed: Nov. 26, 2018

Related U.S. Application Data

(63) Continuation-in-part of application No. 16/055,843, filed on Aug. 6, 2018, now Pat. No. 10,479,592.

(51) Int. Cl.

| | |
|---|---|
| ***B65D 83/00*** | (2006.01) |
| ***B65D 83/22*** | (2006.01) |
| ***B65D 83/20*** | (2006.01) |
| ***B65D 83/38*** | (2006.01) |
| *B65D 47/26* | (2006.01) |

(52) U.S. Cl.
CPC ..... *B65D 83/22* (2013.01); *B65D 83/205* (2013.01); *B65D 83/384* (2013.01); *B65D 47/261* (2013.01); *B65D 2547/04* (2013.01)

(58) Field of Classification Search
CPC .... B65D 83/22; B65D 83/384; B65D 83/388; B65D 47/261; B65D 83/205; B65D 2547/04; F41H 9/10
See application file for complete search history.

(56) References Cited

U.S. PATENT DOCUMENTS

| | | | | |
|---|---|---|---|---|
| 2,908,244 | A | 10/1959 | Clark | |
| 4,044,922 | A * | 8/1977 | Bordelon | B65D 83/384 222/183 |
| 5,366,118 | A | 11/1994 | Ciammitti et al. | |
| 5,379,924 | A | 1/1995 | Taylor | |
| 5,458,263 | A | 10/1995 | Ciammitti et al. | |
| 5,531,359 | A * | 7/1996 | Winner | B65D 83/384 222/153.11 |
| 5,556,003 | A | 9/1996 | Johnson et al. | |
| 7,922,041 | B2 | 4/2011 | Gurrisi et al. | |
| 8,313,009 | B2 * | 11/2012 | Parisi | F41H 9/10 222/153.11 |
| 8,556,125 | B2 | 10/2013 | Dapper | |
| 8,622,256 | B2 | 1/2014 | Campbell | |
| 9,205,618 | B2 | 12/2015 | Campbell | |
| 9,803,954 | B2 | 10/2017 | Scarr | |
| 10,144,563 | B1 * | 12/2018 | Caruso | B65D 83/388 |
| 2014/0252036 | A1 | 9/2014 | Ballard | |

* cited by examiner

*Primary Examiner* — J C Jacyna
(74) *Attorney, Agent, or Firm* — Simpson & Simpson, PLLC

(57) ABSTRACT

A case for securing an aerosol canister, including a body, including, a lateral wall having a top edge and a bottom edge, and a bottom wall connected to the lateral wall proximate the bottom edge, and an attachment means engageable with the bottom wall.

20 Claims, 12 Drawing Sheets

AEROSOL CANISTER CARE WITH LOCKING TWIST CAP

CROSS-REFERENCE TO RELATED APPLICATIONS

This application is filed under 35 U.S.C. § 120 as a continuation-in-part of U.S. patent application Ser. No. 16/055,843, filed on Aug. 6, 2018, which application is herein incorporated by reference in its entirety.

FIELD

The invention relates generally to a case for an aerosol canister, and, more specifically, to a case having a cap that rotates to lock and unlock.

BACKGROUND

Cases for aerosol or spray canisters typically include an actuator to engage the stem of the canister in order to dispel the canister's contents. There are a variety of aerosol dispensers that are used in many applications which include dispensing perfume, air fresheners, personal hygiene products, covering an article with a coat of paint, and dispensing cleaning products, amongst others. One specific application for an aerosol dispenser is as a personal defense device that, for example, directs a chemical repellant spray towards a potential human or animal threat.

Typical aerosol canisters come in a cylindrical shape with no way of securing it to the user's body. With respect to personal defense devices, easy access to dispensing the contents of the canister is crucial to ensure the safety of the user when a threat presents itself. However, the reason personal defense devices are effective is because their chemical contents are indiscriminately extremely painful to anyone who comes into contact with it. Thus, it is important that the user has quick access to the canister without having to carry it in hand. Additionally, it is important to be able to lock the canister to prevent contents from inadvertently or unintentionally dispensing.

Therefore, there is a long-felt need for an improved aerosol canister case that can be easily locked and unlocked as well as easily attachable to a user's clothing such that it is easily accessible.

SUMMARY

According to aspects illustrated herein, there is provided a case for securing an aerosol canister, comprising a body, including, a lateral wall having a top edge and a bottom edge, and a bottom wall connected to the lateral wall proximate the bottom edge, and an attachment means engageable with the bottom wall.

According to aspects illustrated herein, there is provided a case for securing an aerosol canister, comprising a body, including a lateral wall having a top edge and a bottom edge, a bottom wall connected to the lateral wall proximate the bottom edge, and at least one hole in the bottom wall, and an attachment means, including an arm, and at least one prong connected to the arm and engageable with the at least one hole.

According to aspects illustrated herein, there is provided a case for securing an aerosol canister, comprising a body, including a first lateral wall having a first top edge and a first bottom edge, a bottom wall connected to the first lateral wall proximate the first bottom edge, and at least one cutout arranged in the first lateral wall proximate the first top edge, and a cap connected to the body, including a second lateral wall having a second top edge and a second bottom edge, a top wall connected to the second lateral wall proximate the second top edge, a nozzle in fluid contact with a stem of the aerosol canister, and at least one gusset arranged to engage the at least one cutout, wherein in an unlocked position, the cap is displaceable in a first axial direction relative to the body to dispense the contents of the aerosol canister out of the nozzle, and in a locked position, the cap is not displaceable in the first axial direction.

According to aspects illustrated herein, there is provided a case for securing an aerosol canister, comprising a body, including a first lateral wall having a first top edge and a first bottom edge, a bottom wall connected to the first lateral wall proximate the first bottom edge, and at least one cutout arranged in the first lateral wall proximate the first top edge, and a cap connected to the body, the cap concentrically arranged around the body proximate the first top edge and including a second lateral wall having a second top edge and a second bottom edge, a top wall connected to the second lateral wall proximate the second top edge, a nozzle in fluid contact with a stem of the aerosol canister, and at least one gusset arranged to engage the at least one cutout, wherein in an unlocked position, the cap is displaceable in a first axial direction relative to the body to dispense the contents of the aerosol canister out of the nozzle, and in a locked position, the cap is not displaceable in the first axial direction.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

By "non-rotatably connected" elements, we mean that: the elements are connected so that whenever one of the elements rotate, all the elements rotate; and relative rotation between the elements is not possible. Radial and/or axial movement of non-rotatably connected elements with respect to each other is possible, but not required. By "rotatably connected" elements, we mean that the elements are rotatable with respect to each other.

Figure 1B:
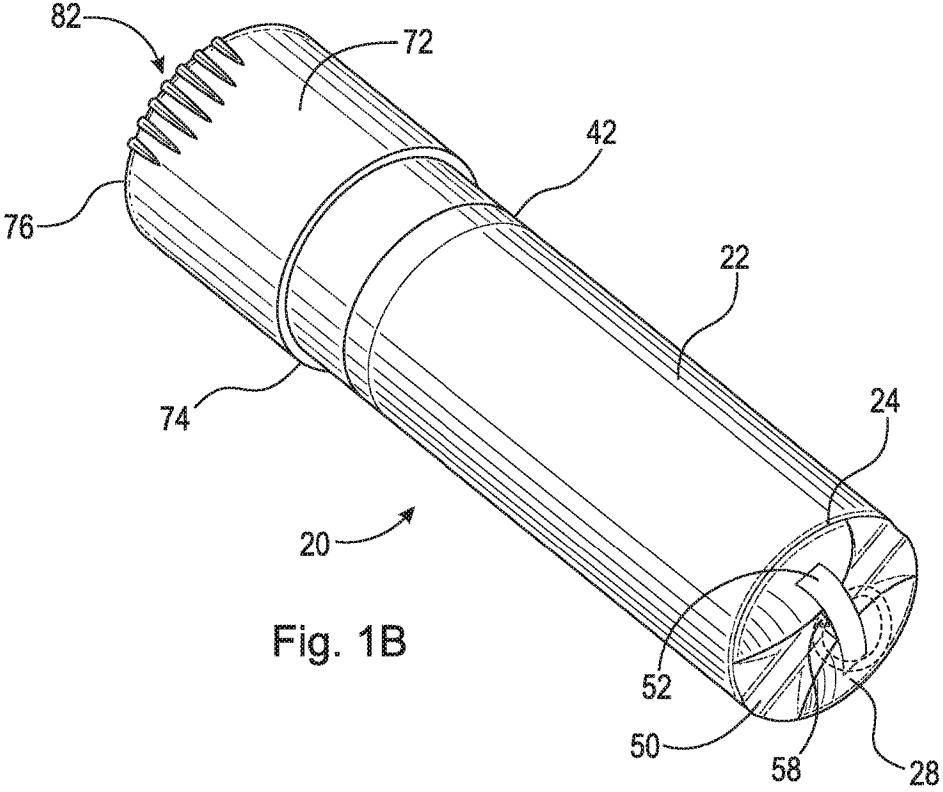
FIG. 1B is a bottom perspective view of the case shown in FIG. 1A.
Figure 1A:
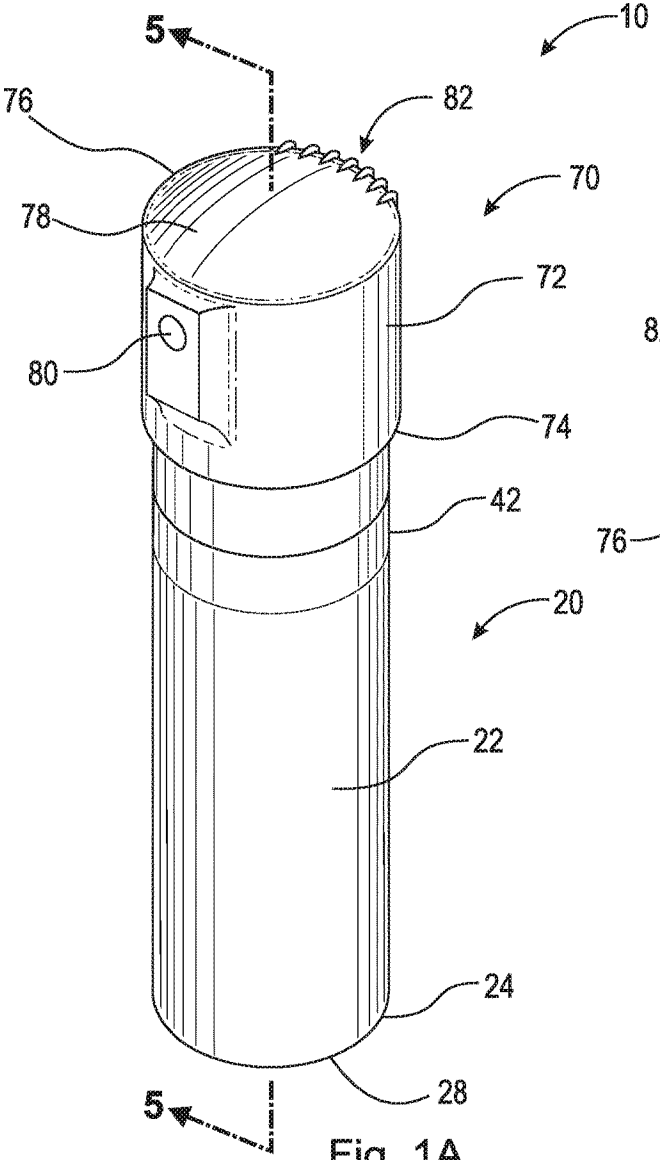
FIG. 1A is a top perspective view of a case.
Figure 2B:
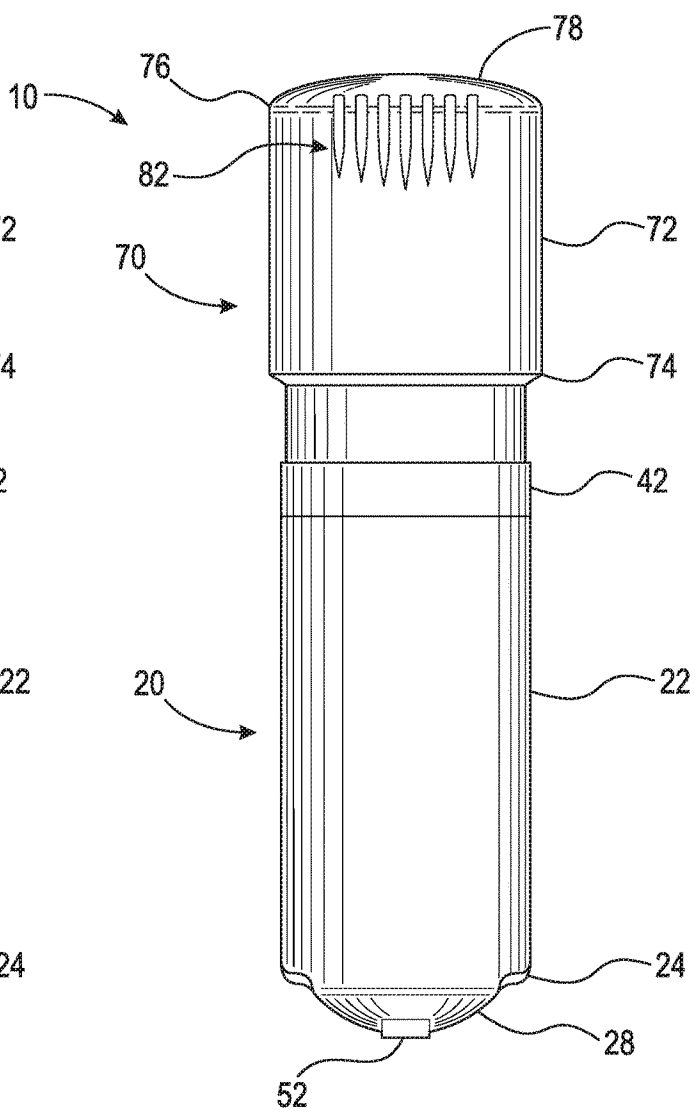
FIG. 2B is a rear elevational view of the case shown in FIG. 1A.
Figure 2A:
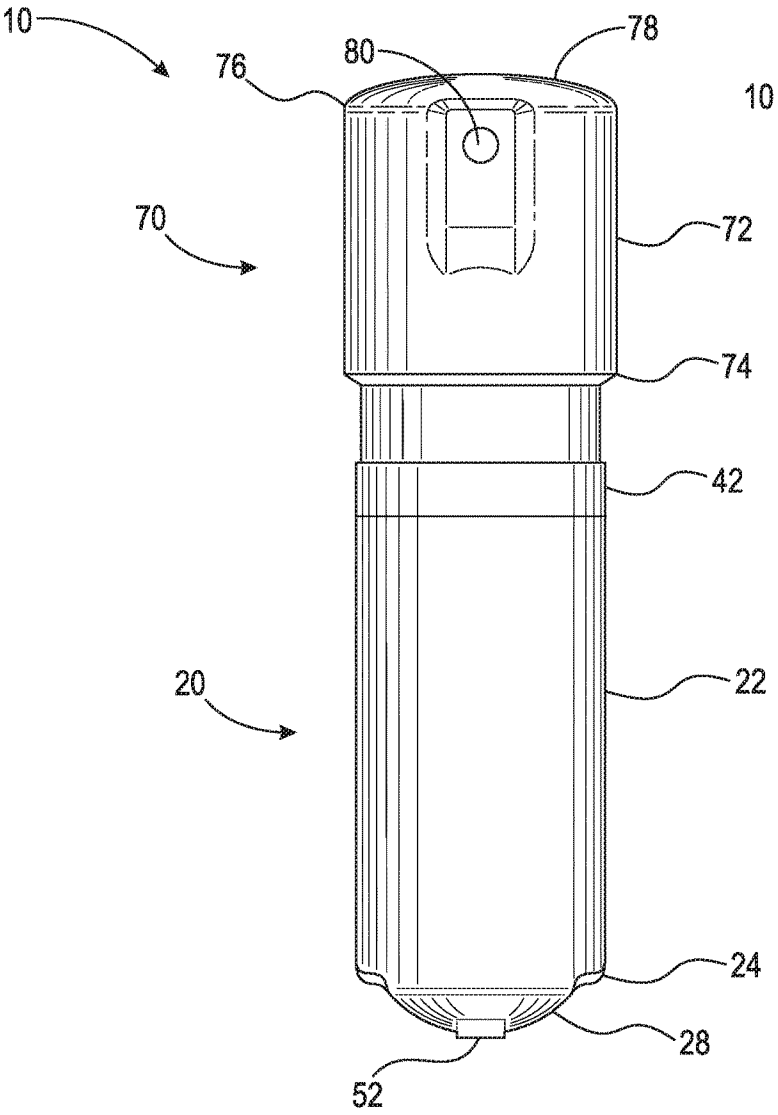
FIG. 2A is a front elevational view of the case shown in FIG. 1A.
Figure 2D:
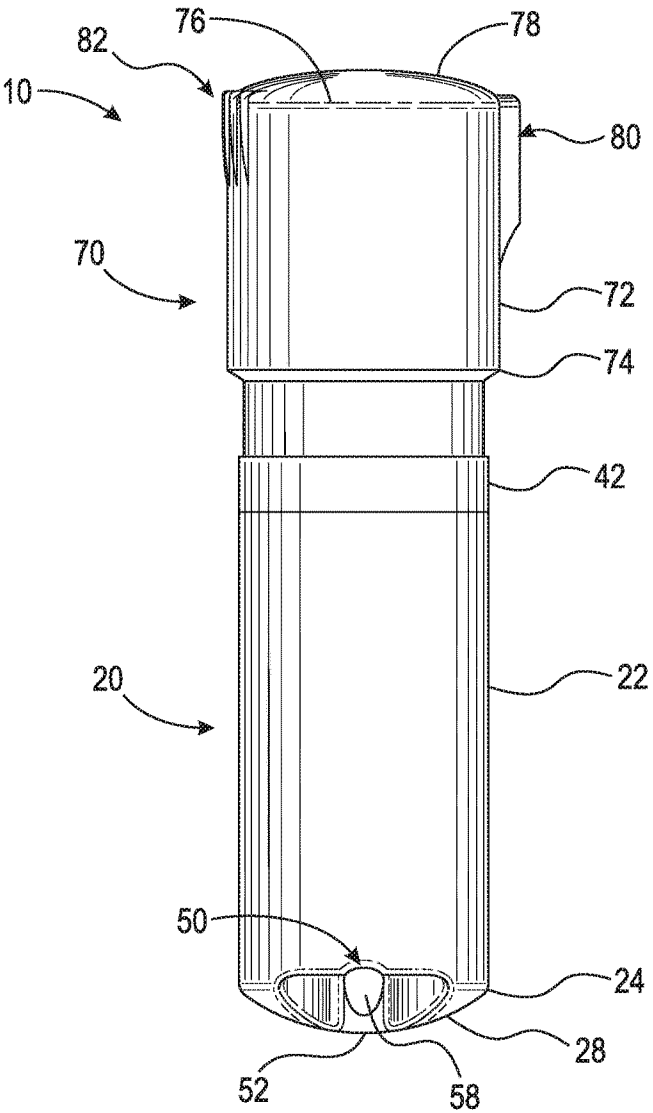
FIG. 2D is a left side elevational view of the case shown in FIG. 1A.
Figure 2C:
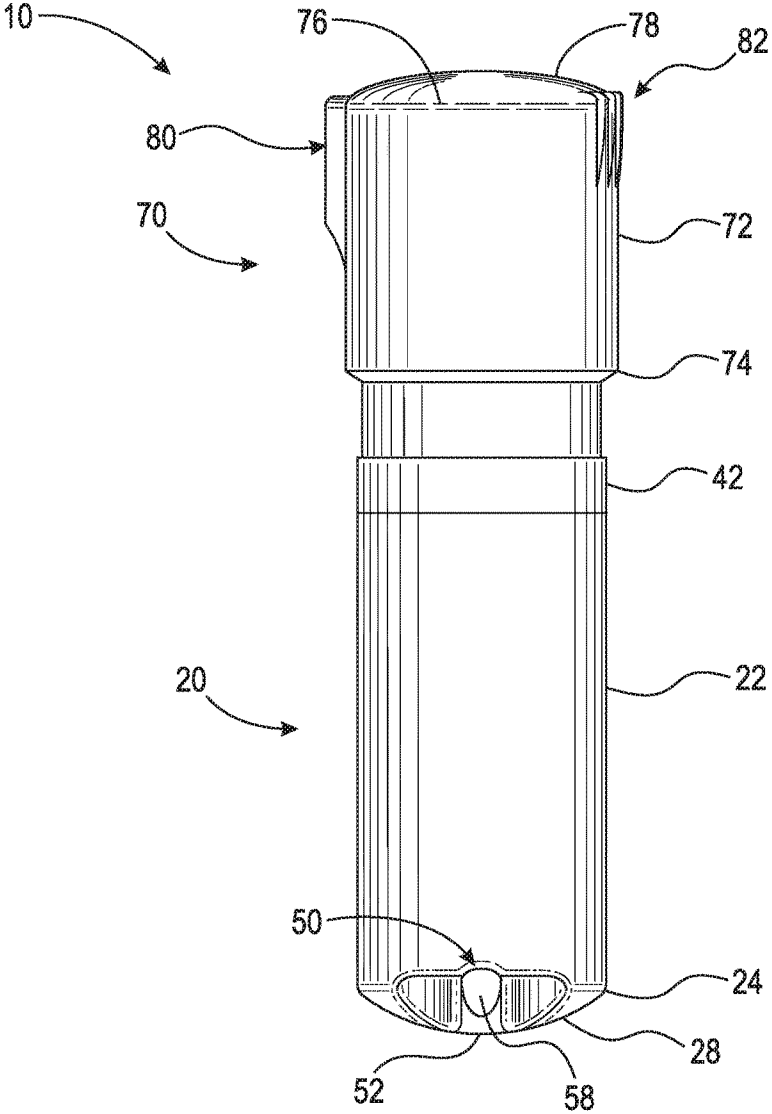
FIG. 2C is a right side elevational view of the case shown in FIG. 1A.
Figure 2E:
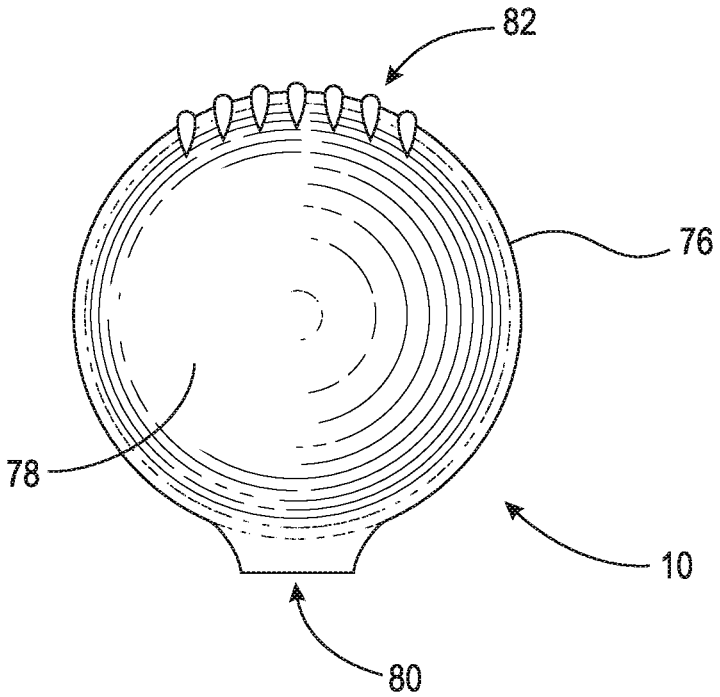
FIG. 2E is a top elevational view of the case shown in FIG. 1A.
Figure 2F:
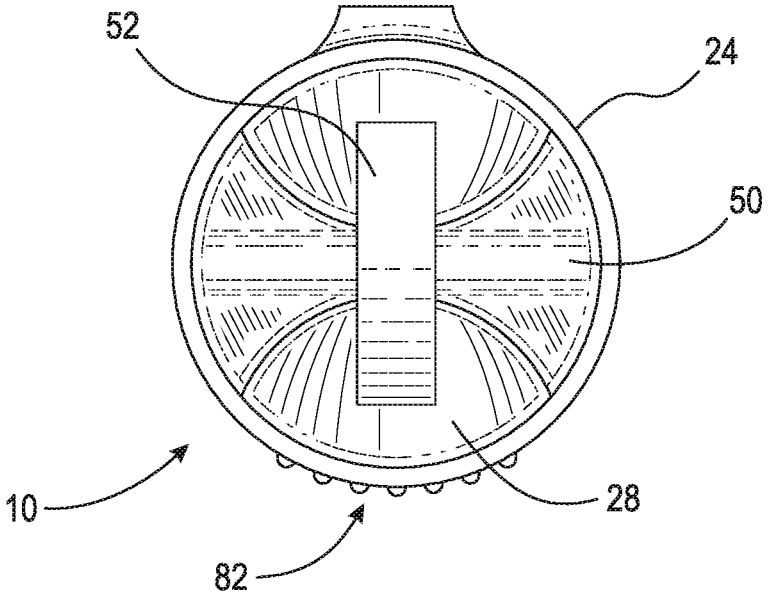
FIG. 2F is a bottom elevational view of the case shown in FIG. 1A.
Figure 3:
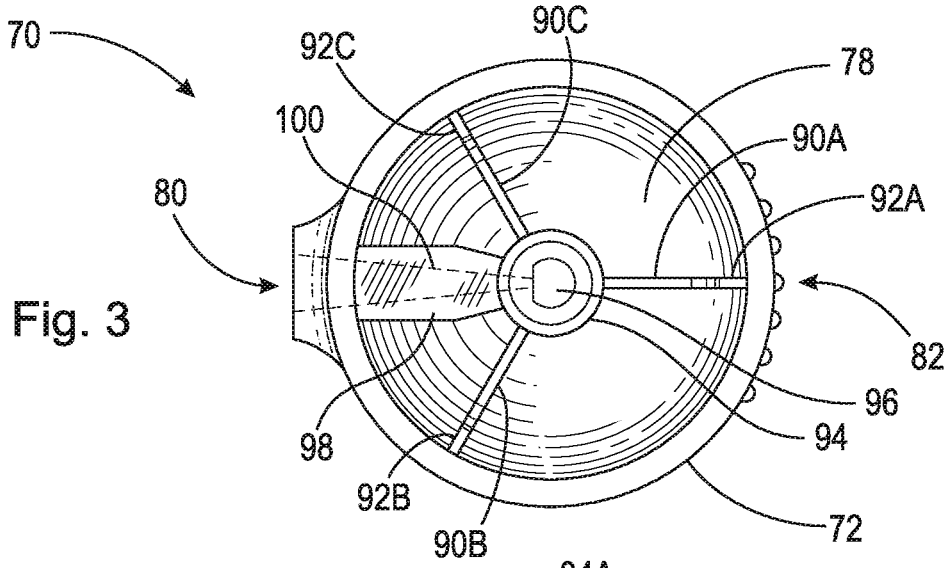
FIG. 3 is a bottom elevational view of a cap as shown in FIG. 1A.
Figure 4:
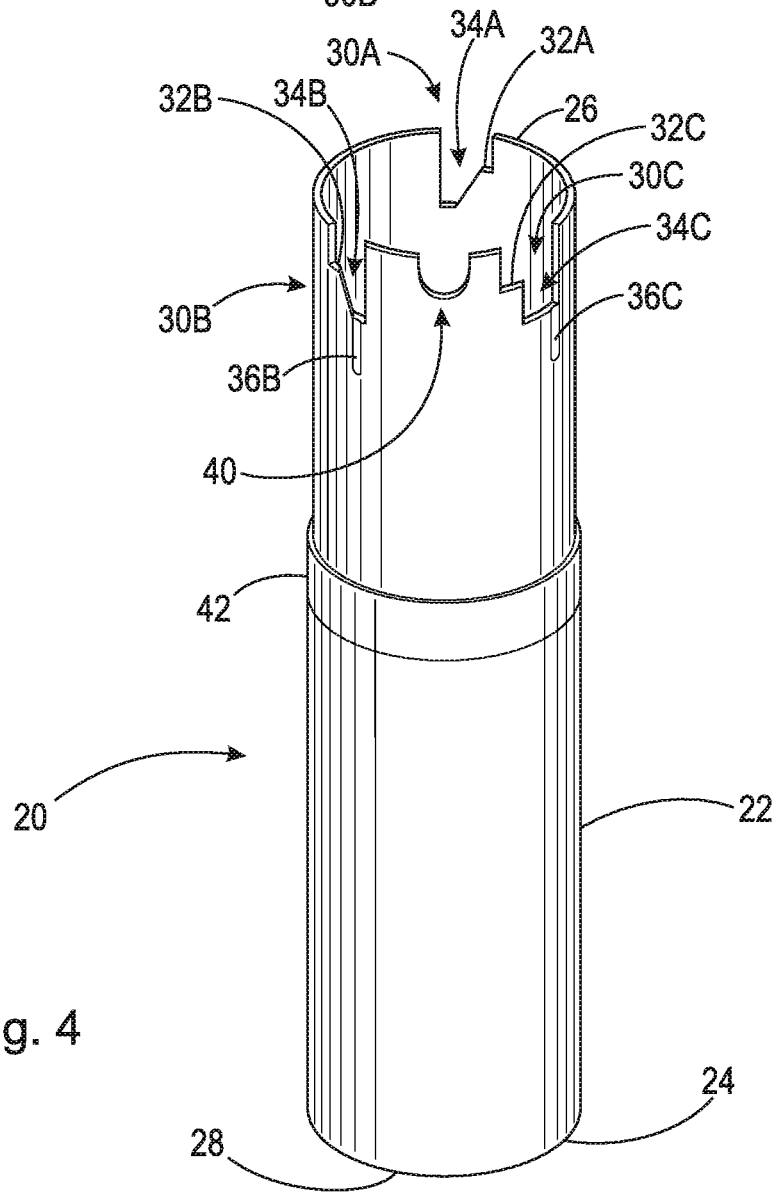
FIG. 4 is a top perspective view of a body as shown in FIG. 1A.
Figure 5:
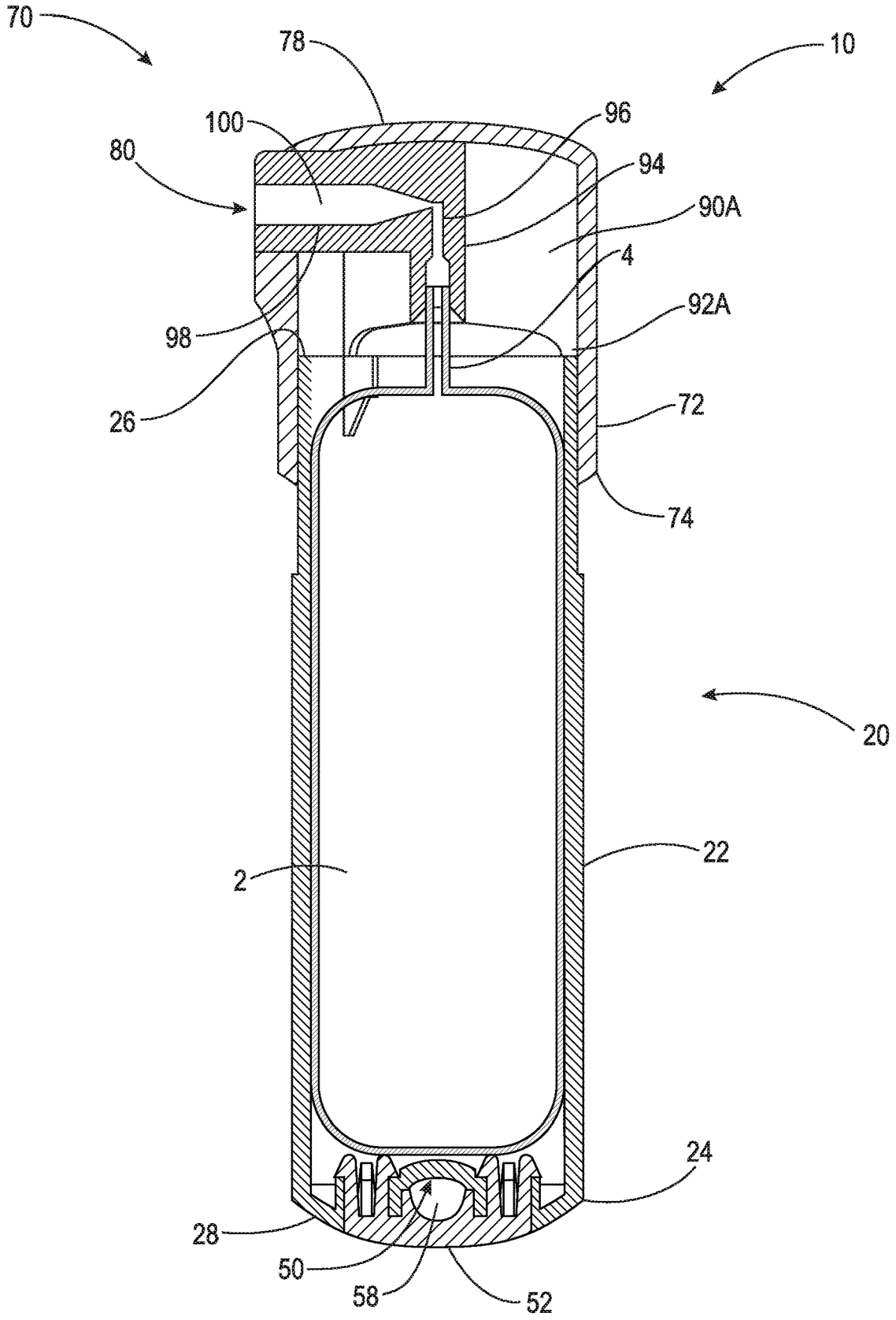
FIG. 5 is a cross-sectional view of the case taken generally along line 5-5 in FIG. 1A.

Adverting now to the figures, FIG. 1A is a top perspective view of case 10. FIG. 1B is a bottom perspective view of case 10. FIG. 2A is a front elevational view of case 10. FIG. 2B is a rear elevational view of case 10. FIG. 2C is a right side elevational view of case 10. FIG. 2D is a left side elevational view of case 10. FIG. 2E is a top elevational view to of case 10. FIG. 2F is a bottom elevational view of case 10. FIG. 3 is a bottom elevational view of cap 70. FIG. 4 is a top perspective view of body 20. FIG. 5 is a cross-sectional view of case 10 taken generally along line 5-5 in FIG. 1A. The following description should be read in view of FIGS. 1-5. Case 10 generally comprises body 20 and cap 70.

Body 20 comprises lateral wall 22 and bottom wall 28. Lateral wall 22 is generally cylindrical having a circular cross section and comprises edge 24 and edge 26. It should be appreciated that lateral wall 22 may be any shape suitable for housing a canister (e.g., an aerosol canister), such as a triangular, rectangular, square, octagonal, hexagonal, ovular, ellipsoidal, or polygonal geometry. Bottom wall 28 is connected to lateral wall 22 at edge 24. Bottom wall 28 may be planar or curvilinear and includes channel 50. Bottom wall 28 is arranged to engage a connection element (e.g., ring attachment 52 or clip attachment 56) and will be discussed in greater detail below. Hole 58 is formed between the connection element and channel 50. Lateral wall 22 comprises, proximate edge 26, cutouts 30A, 30B, 30C, and 40, as shown in FIG. 4. Cutouts 30A-C are generally equidistantly circumferentially spaced from each other, for example, at 0°, 120°, and 240°. In some embodiments, cutouts 30A-C are not equidistantly circumferentially spaced. It should be appreciated that cutouts 30A-C may be arranged at any location along edge 26 suitable for engagement with respective gussets, as will be described in greater detail below. Furthermore, it should be appreciated that body 20 may have any number of cutouts, for example, one or more, suitable for engagement with respective gussets. Cutout 30A extends axially from edge 26 and comprises ledge 32A and notch 34A. Ledge 32A is substantially parallel to edge 26. In some embodiments, ledge 32A is non-parallel to edge 26. Notch 34A is generally V-shaped; however, it should be appreciated that notch 34A may comprise any geometry suitable for engagement with respective gussets, as will be discussed in greater detail below, such as rectangular, ovular, ellipsoidal, square, etc. Cutout 30B extends axially from edge 26 and comprises ledge 32B and notch 34B. As shown in FIG. 4, cutout 30B is substantially similar to cutout 30A. Ledge 32B is substantially parallel to edge 26. In some embodiments, ledge 32B is non-parallel to edge 26. Notch 34B is generally V-shaped; however, it should be appreciated that notch 34B may comprise any geometry suitable for engagement with respective gussets, as will be discussed in greater detail below, such as rectangular, ovular, ellipsoidal, square, etc. Cutout 30C extends axially from edge 26 and comprises ledge 32C and notch 34C. Ledge 32C is substantially parallel to edge 26. In some embodiments, ledge 32C is non-parallel to edge 26. Notch 34C is generally rectangular-shaped; however, it should be appreciated that notch 34C may comprise any geometry suitable for engagement with respective gussets, as will be discussed in greater detail below, such as V-shaped, ovular, ellipsoidal, square, etc. Cutout 40 extends axially from edge 26 and is arranged for engagement with outlet conduit 98. Cutout 40 is generally semicircular-shaped; however, it should be appreciated that notch 40 may comprise any geometry suitable for engagement with outlet conduit 98, such as rectangular, ovular, ellipsoidal, square, etc. In the embodiment shown, cutout 40 is arranged circumferentially between cutouts 30B and 30C. In some embodiments, body 20 may further comprise grooves 36A (not shown), 36B, and 36C, arranged proximate and/or adjacent to notches 34A, 34B, and 34C, respectively. In some embodiments, body 20 may further comprise rib 42 circumferentially arranged around lateral wall 72.

Cap 70 comprises lateral wall 72 and top wall 78. Lateral wall 72 is generally cylindrical having a circular cross section and comprises edge 74 and edge 76. It should be appreciated that lateral wall 72 may be any shape suitable for housing a canister (e.g., an aerosol canister) and slidingly engaging and connecting to body 20, such as a triangular, rectangular, square, octagonal, hexagonal, ovular, ellipsoidal, or polygonal geometry. Top wall 78 is connected to lateral wall 72 at edge 76. Top wall 78 may be planar or curvilinear. Lateral wall 72 comprises, proximate edge 26, nozzle 80 and one or more ribs 82. Nozzle 80 is generally a hole that extends through lateral wall 72 to outlet conduit 98 for dispersing of the contents of the canister. Ribs 82 are arranged substantially diametrically opposed to nozzle 80. Ribs 82 are arranged to provide the user with grip and also a general sense of which direction nozzle 80 is directed (i.e., nozzle 80 is arranged 180° from ribs 82). The user may place a thumb or finger on ribs 82, and rotate cap 70 with respect to body 20 in order to lock/unlock case 10, as will be discussed in greater detail below. As shown in FIG. 3, cap 70 further comprises outlet conduit 98, inlet conduit 94, and gussets 90A-C. Inlet conduit 94 is generally arranged concentric to lateral wall 72. Inlet 94 is connected to top wall 78 and comprises hole 96. Outlet conduit 98 is connected to top wall 78 and extends from inlet conduit 94 to nozzle 80. Outlet conduit 98 comprises hole 100 which is connected to hole 96 and nozzle 80. Inlet conduit 94 is arranged to connect to stem 4 of aerosol canister 2, as shown in FIG. 5. Hole 96, hole 100, and nozzle 80 provide a passage for the contents of aerosol canister 2 to be dispersed from stem 4 (when actuated), out of cap 70.

Gusset 90A is connected to top wall 78 and extends from inlet conduit 94 to lateral wall 72. Gusset 90A increases the strength of cap 70 and also is arranged to engage cutout 30A. Specifically, gusset 90A comprises downwardly projecting protrusion 92A which engages either notch 34A, when cap 70 is in the unlocked position, or ledge 32A, when cap 70 is in the locked position. Gusset 90B is connected to top wall 78 and extends from inlet conduit 94 to lateral wall 72. Gusset 90B increases the strength of cap 70 and also is arranged to engage cutout 30B. Specifically, gusset 90B comprises downwardly projecting protrusion 92B which engages either notch 34B, when cap 70 is in the unlocked position, or ledge 32B, when cap 70 is in the locked position. Gusset 90C is connected to top wall 78 and extends from inlet conduit 94 to lateral wall 72. Gusset 90C increases the strength of cap 70 and also is arranged to engage cutout 30C. Specifically, gusset 90C comprises downwardly projecting protrusion 92C which engages either notch 34C, when cap 70 is in the unlocked position, or ledge 32C, when cap 70 is in the locked position. It should be appreciated that cap 70 may comprise any number of gussets, for example one or more gussets, suitable to engage one or more cutouts of body 20 and lock and unlock cap 70 axially with respect to body 20. Additionally, in some embodiments the gussets do not include downwardly projecting protrusions, but rather the gussets themselves interact and engage the cutouts of body 20. Gussets 90A-C may comprise any geometric shape suitable to engage cutouts 30A-C, respectively.

Cap 70 is arranged to be concentrically engaged around body 20. Cap 70 is capable of translational movement, that is, movement in axial directions AD1 and AD2 with respect to body 20, as well as rotational movement, that is, movement in circumferential directions CD1 and CD2. When engaged, cap 70 may be limited in axial movement with respect to body 20. When cap 70 is in the locked position, downwardly projecting protrusion 92A abuts against or substantially against ledge 32A, preventing cap 70 from being displaced axially relative to body 20. When cap 70 is in the unlocked position, downwardly projecting protrusions 92A-C are circumferentially aligned with notches 34A-C, respectively, which allows cap 70 to be axially displaced relative to body 20. When cap 70 is displaced axially relative to body 20, inlet conduit 94 engages and displaces stem 4, which allows the contents of aerosol canister 2 to be dispensed through hole 96, hole 100, and out through nozzle 80.

Figure 6A:
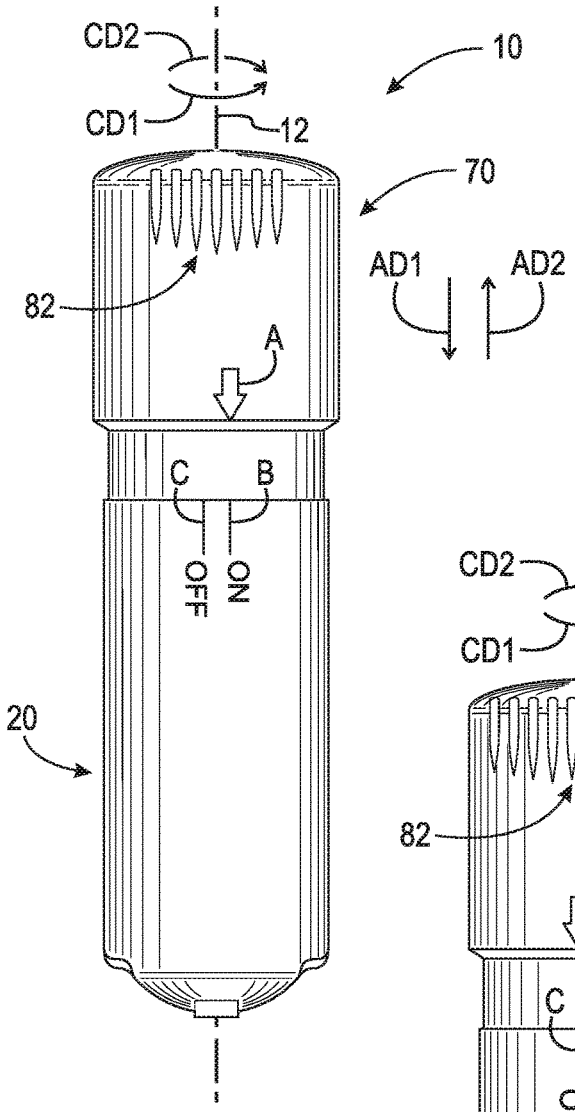
FIG. 6A is a rear elevational view of the case as shown in FIG. 1A, with the cap arranged in an unlocked position.

FIG. 6A is a rear elevational view of case 10 with cap 70 arranged in an unlocked position. In the unlocked position, arrow A on cap 70 is circumferentially aligned with position B (e.g., the ON position) of body 20. In the unlocked position, gussets 90A-C are aligned with notches 34A-C of cutouts 30A-C, respectively, which allows cap 70 to be displaced in axial direction AD1 with respect to body 20. To arrange case 10 in the unlocked position, cap 70 is rotated in circumferential direction CD1 until arrow A is aligned with position B. The engagement of gussets 90A-C with cutouts 30A-C only allow cap 70 to be rotated from position C to position B and back to position C. In some embodiments, cutouts 30A-C do not limit circumferential movement between cap 70 and body 20. Cap 70 may be rotated via the user's thumb or finger. While the user holds body 20 in the hand, the user places the thumb on ribs 82 and rotates cap 70 in either circumferential direction CD1 or circumferential direction CD2 depending on the desired position.

Figure 6B:
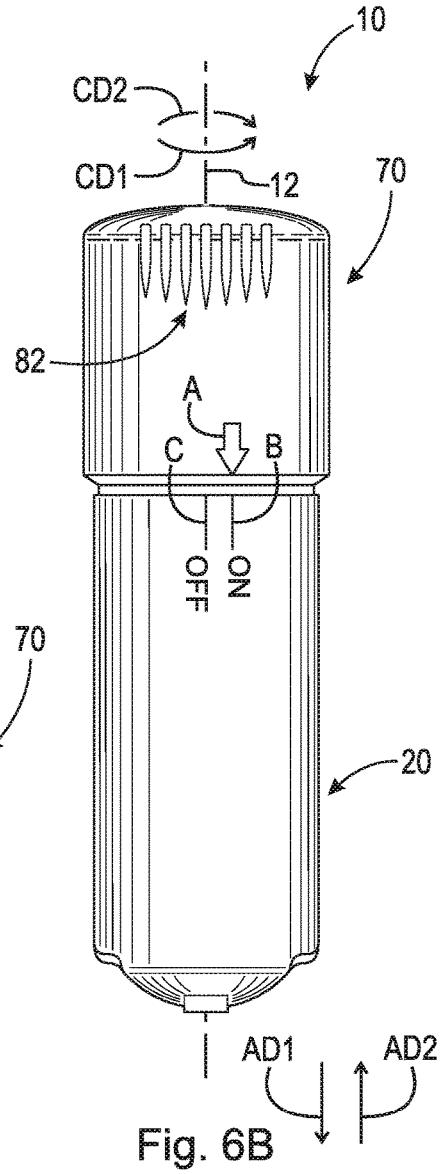
FIG. 6B is a rear elevational view of the case as shown in FIG. 6A, with the cap depressed relative to the body.

FIG. 6B is a rear elevational view of case 10 with cap 70 depressed relative to body 20. In the unlocked position, cap 70 is displaced in axial direction AD1 relative to body 20, which causes inlet conduit 94 to engage stem 4, thus dispensing the contents of aerosol canister 2 through hole 96, hole 100, and out through nozzle 80. Cap 70 may, for example, be displaced by a user's thumb or finger, which is arranged on ribs 82. Once the user releases the pressure applied in axial direction AD1 to cap 70, stem 4 forces cap 70 in axial direction AD2 back to its original position. In some embodiments, cap 70 comprises a spring or other resilient element arranged between cap 70 and aerosol canister 2 to return cap 70 to its original position after pressure to cap 70 has been removed.

Figure 6C:
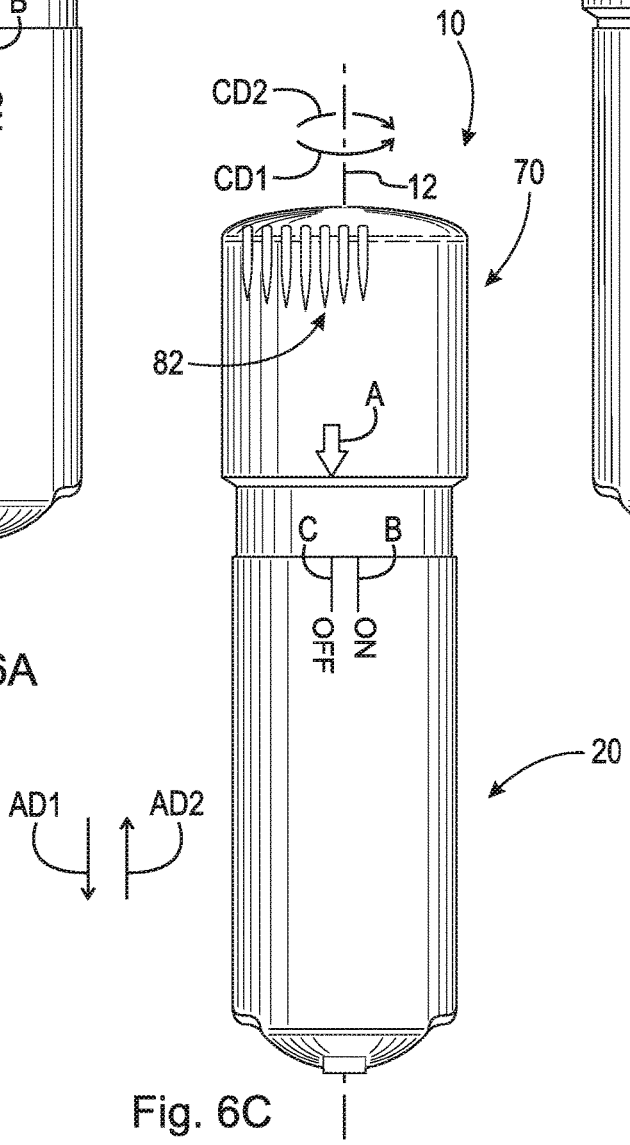
FIG. 6C is a rear elevational view of the case as shown in FIG. 1A, with the cap arranged in a locked position.

FIG. 6C is a rear elevational view of case 10 with cap 70 arranged in a locked position. In the locked position, arrow A on cap 70 is circumferentially aligned with position C (e.g., the OFF position) of body 20. In the locked position, gussets 90A-C are aligned with ledges 32A-C of cutouts 30A-C, respectively, which prevents cap 70 from being displaced in axial direction AD1 with respect to body 20. To arrange case 10 in the locked position, cap 70 is rotated in circumferential direction CD2 until arrow A is aligned with position C.

Figure 7A:
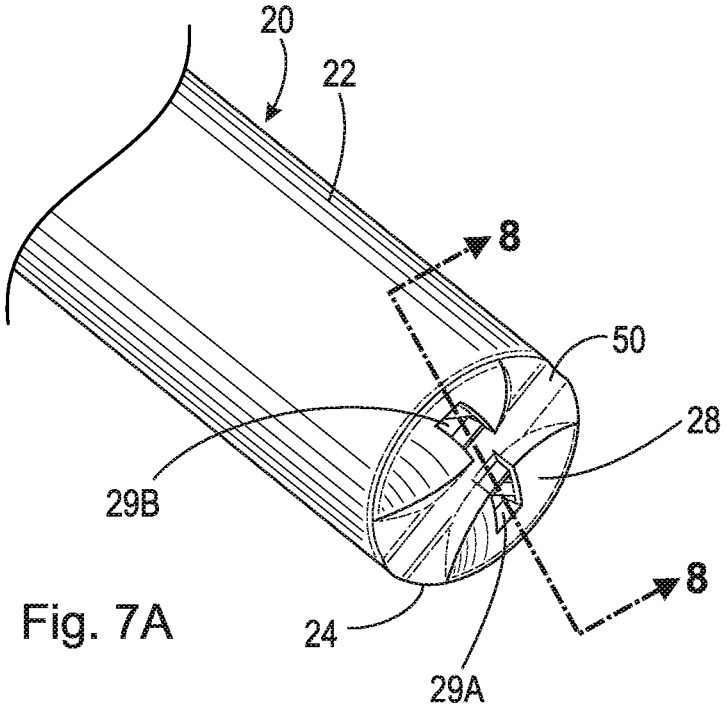
FIG. 7A is a bottom perspective view of the case as shown in FIG. 1A with the attachment element removed.

FIG. 7A is a bottom perspective view of case 10 with the attachment element removed. As shown, bottom wall 28 comprises channel 50 and holes 29A-B. Holes 29A-B allow for attachment of an attachment element to body 20 such that case 10 may be easily connected to, for example, a key chain or an article of clothing. Hole 58 is formed between the attachment element and channel 50.

Figure 7B:
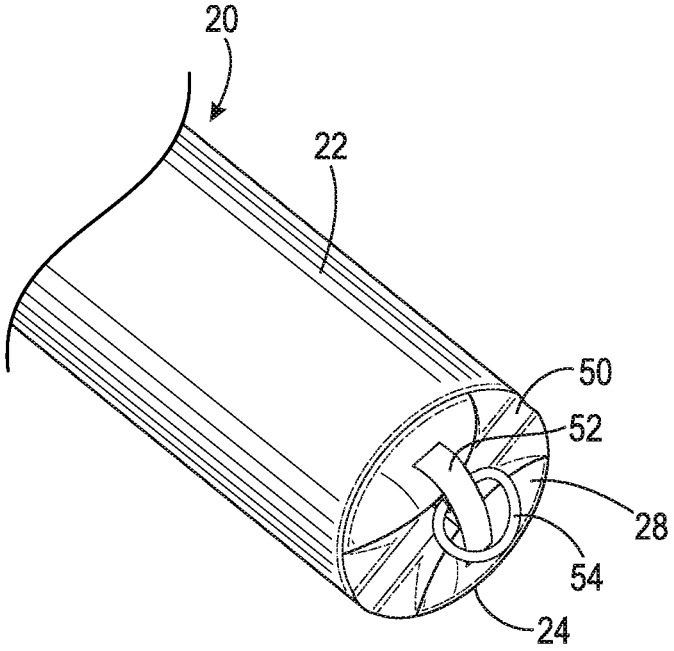
FIG. 7B is a bottom perspective view of the case as shown in FIG. 7A with a ring attachment secured thereto.

FIG. 7B is a bottom perspective view of case 10 with ring attachment 52 secured thereto. Ring 54 may be secured to ring attachment 52 for connection to, for example, a key chain. In some embodiments, a string, wire, cable, chain, etc. is secure to ring attachment 52. Ring attachment 52 will be discussed in greater detail below.

Figure 7C:
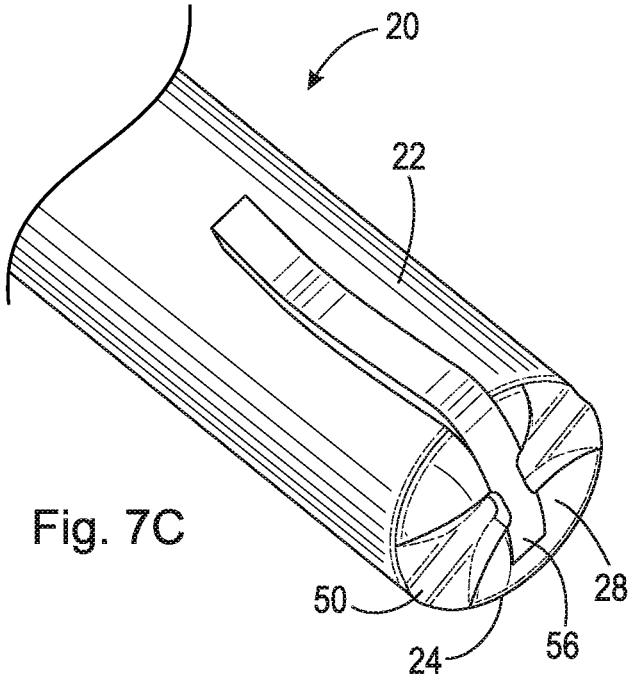
FIG. 7C is a bottom perspective view of the case as shown in FIG. 7A with a clip attachment secured thereto.

FIG. 7C is a bottom perspective view of case 10 with clip attachment 56 secured thereto. Clip attachment 56 allows case 10 to be secured to, for example, a user's pocket or belt. Clip attachment 56 will be discussed in greater detail below.

Figure 7D:
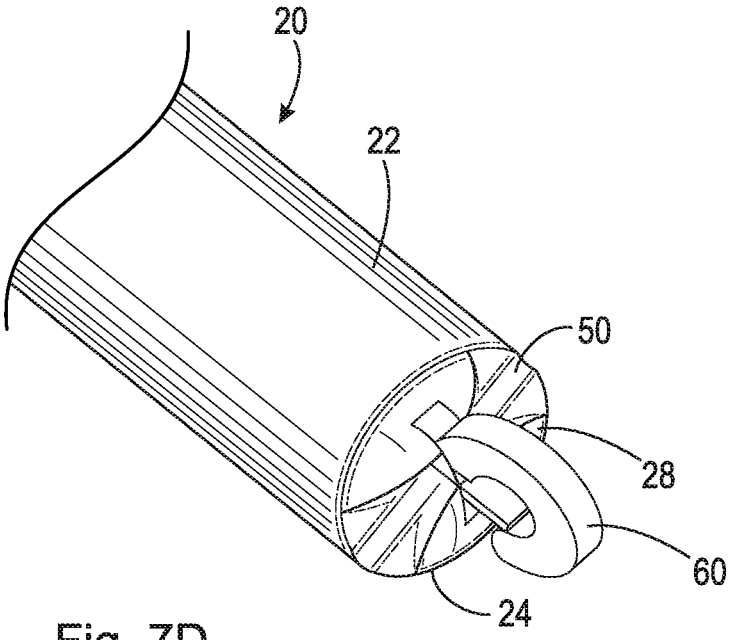
FIG. 7D is a bottom perspective view of the case as shown in FIG. 7A with a snap ring attachment secured thereto.

FIG. 7D is a bottom perspective view of case 10 with snap ring attachment 60 secured thereto. Snap ring attachment 60 allows case to be secured to, for example, a user's pocket or belt, or a bag. Snap ring attachment 60 will be described in greater detail below.

Figure 8:
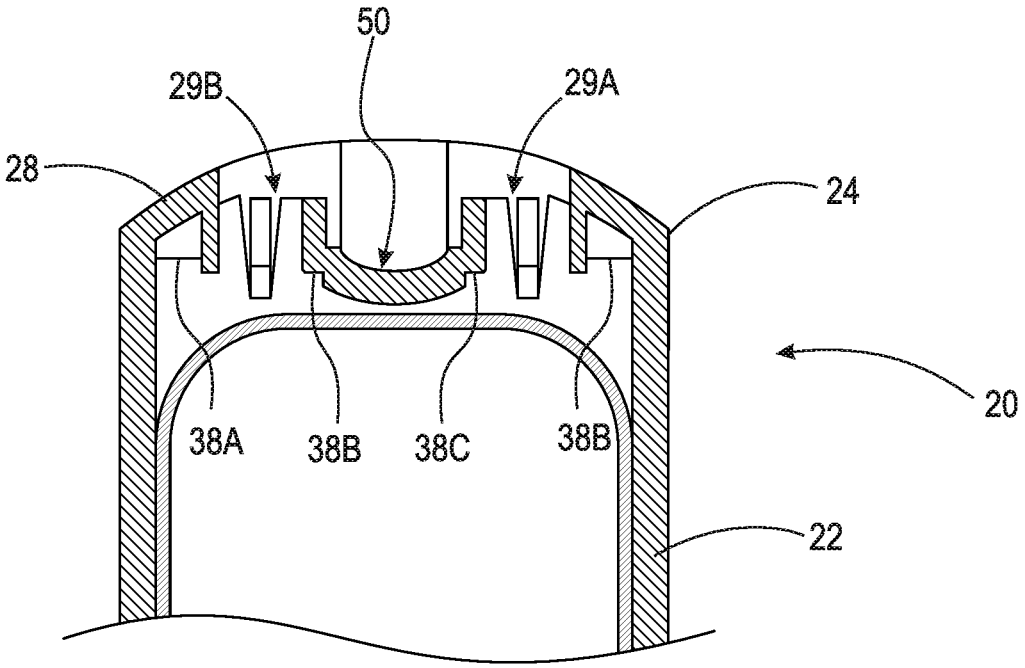
FIG. 8 is a cross-sectional view of the case taken generally along line 8-8 in FIG. 7A.
Figure 9:
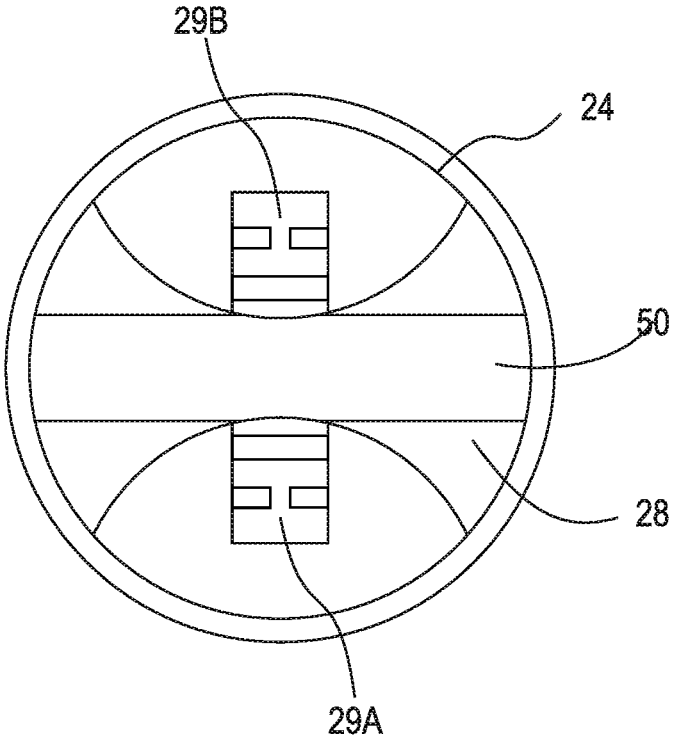
FIG. 9 is a bottom elevational view of the case as shown in FIG. 7A.

FIG. 8 is a cross-sectional view of case 10 taken generally along line 8-8 in FIG. 7A. FIG. 9 is a bottom elevational view of case 10. As shown, body 20 comprises surfaces 38A-D. Specifically, surfaces 38A and 38B correspond to hole 29B and surfaces 38C and 38D correspond to hole 29A. Hole 29A may further comprise one or more protrusions arranged therein, and hole 29B may further comprise one or more protrusions arranged therein. Holes 29A-B are arranged such that an attachment may be easily inserted therein and secured to body 20. One advantage of such design, is that body 20 can be manufactured with one design, and various attachments can be manufactured with the required prongs to be compatible with body 20, as will be discussed in greater detail below.

Figure 10:
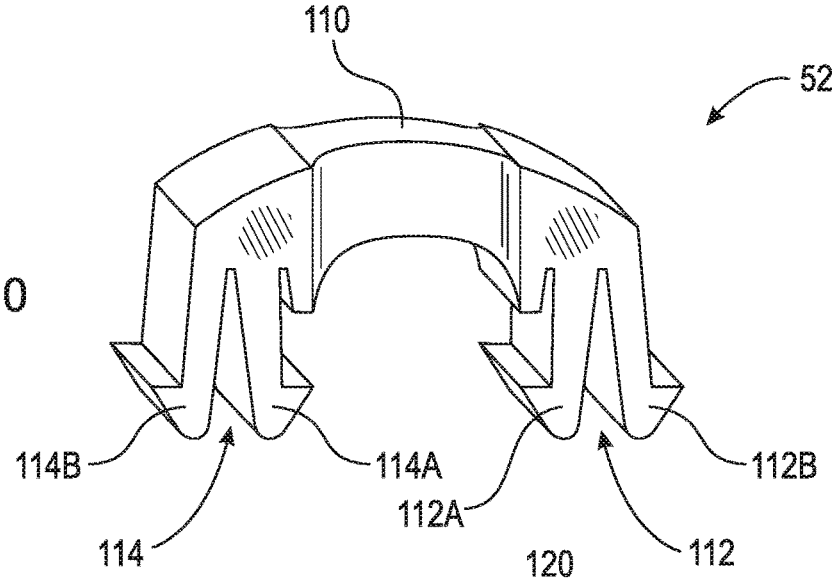
FIG. 10 is a perspective view of a ring attachment as shown in FIG. 7B.

FIG. 10 is a perspective view of ring attachment 52. Ring attachment 52 generally comprises arm 110 and prongs 112 and 114. As shown, prongs 112 and 114 are connected to and extend from arm 110 on opposite ends thereof. Prong 112 comprises inner catch 112A and outer catch 112B. Prong 114 comprises inner catch 114A and outer catch 114B. To secure ring attachment 52 to body 20, prongs 112 and 114 are engaged with holes 29A-B. When fully assembled, catches 112A-B and 114A-B "snap" over respective surfaces 38A-D. For example, catch 114B snaps over surface 38A, catch 114A snaps over surface 38B, catch 112A snaps over surface 38C, and catch 112B snaps over surface 38D, thereby securing ring attachment 52 in body 20 and preventing prongs 114 and 112 from being removed from holes 29B and 29A, respectively. In some embodiments, catch 114B snaps over surface 38D, catch 114A snaps over surface 38C, catch 112A snaps over surface 38B, and catch 112B snaps over surface 38A, thereby securing ring attachment 52 in body 20 and preventing prongs 114 and 112 from being removed from holes 29A and 29B, respectively. In some embodiments, catches 112A-B and 114A-B are elastic.

Figure 11:
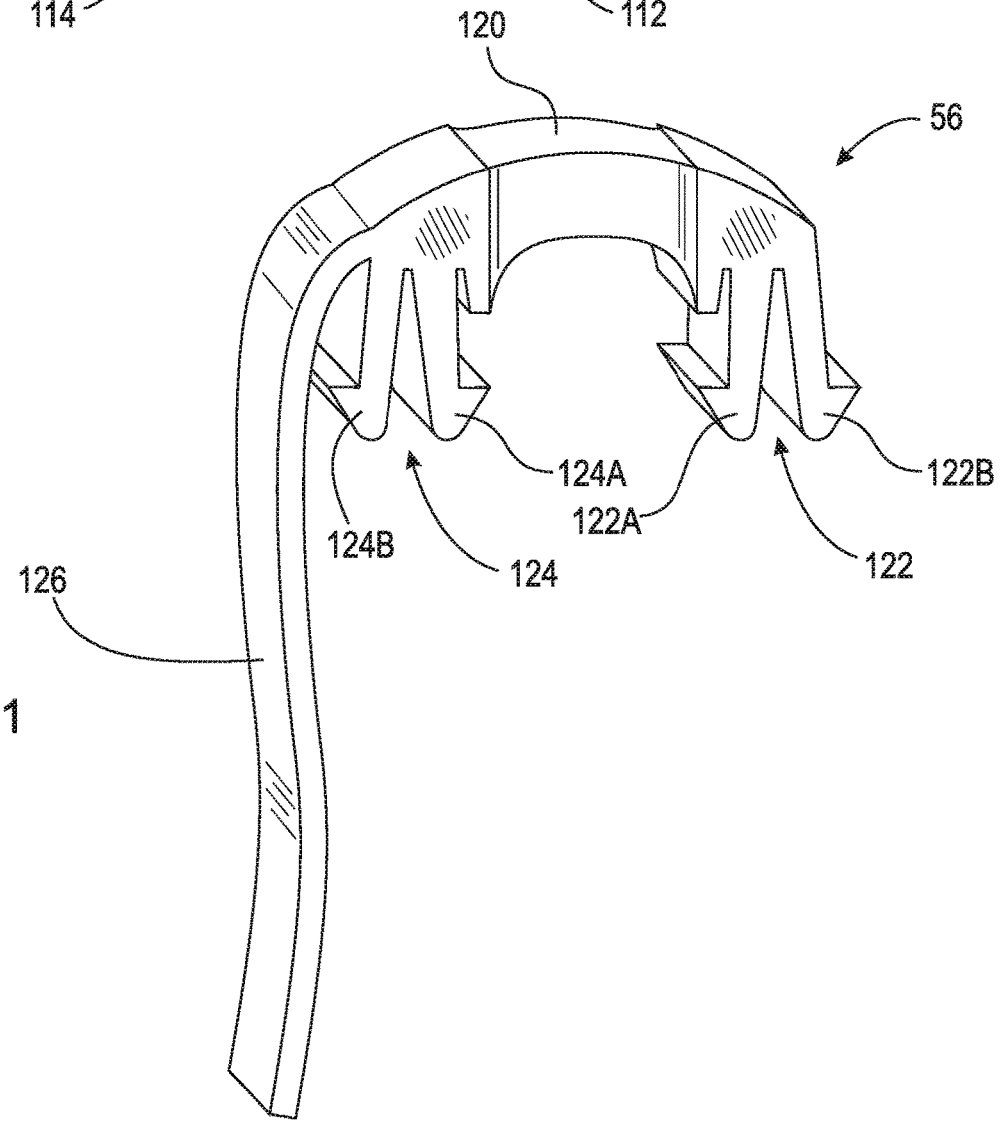
FIG. 11 is a perspective view of a clip attachment as shown in FIG. 7C.

FIG. 11 is a perspective view of clip attachment 56. Clip attachment 56 generally comprises arm 120, prongs 122 and 124, and clip. As shown, prongs 122 and 124 are connected to and extend from arm 120 on opposite ends thereof. Prong 122 comprises inner catch 122A and outer catch 122B. Prong 124 comprises inner catch 124A and outer catch 124B. To secure clip attachment 56 to body 20, prongs 122 and 124 are engaged with holes 29A-B. When fully assembled, catches 122A-B and 124A-B "snap" over respective surfaces 38A-D. For example, catch 124B snaps over surface 38A, catch 124A snaps over surface 38B, catch 122A snaps over surface 38C, and catch 122B snaps over surface 38D, thereby securing clip attachment 56 in body 20 and preventing prongs 124 and 122 from being removed from holes 29B and 29A, respectively. In some embodiments, catch 124B snaps over surface 38D, catch 124A snaps over surface 38C, catch 122A snaps over surface 38B, and catch 122B snaps over surface 38A, thereby securing clip attachment 56 in body 20 and preventing prongs 124 and 122 from being removed from holes 29A and 29B, respectively. In some embodiments, catches 122A-B and 124A-B are elastic. Clip 126 is secured to arm 120. When clip attachment 56 is secured to body 20, clip 126 extends in an axial direction from edge 24 toward cap 70. In some embodiments, clip 126 includes a proximate end connected to arm 120 and a distal end which abuts against or is arranged substantially proximate to lateral wall 22. In some embodiments, clip 126 is elastic.

Figure 12:
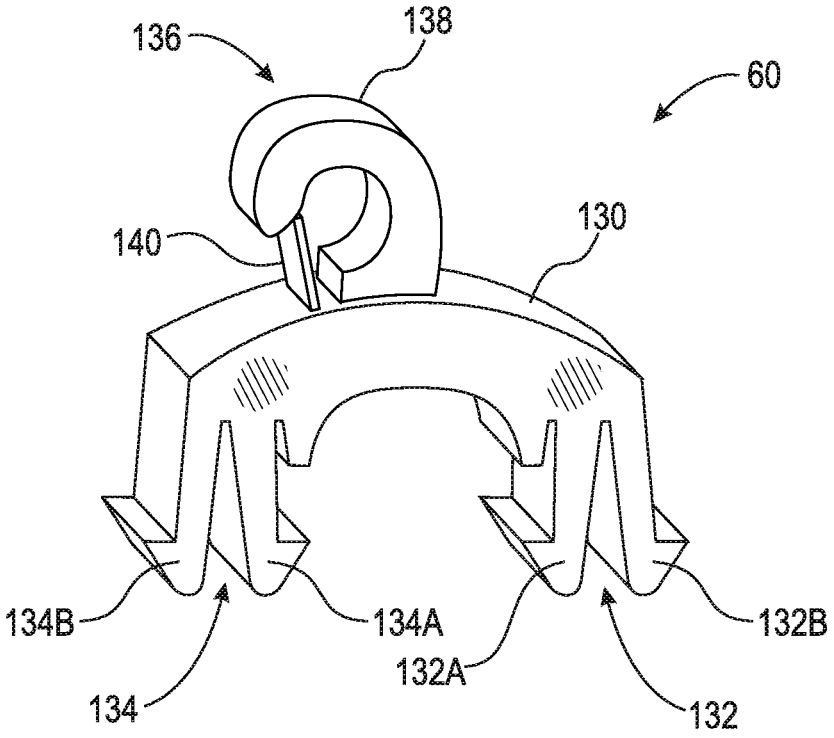
FIG. 12 is a perspective view of a snap ring attachment as shown in FIG. 7D.

FIG. 12 is a perspective view of snap ring attachment 60. Snap ring attachment 60 generally comprises arm 130, prongs 132 and 134, and snap ring 136. As shown, prongs 132 and 134 are connected to and extend from arm 130 on opposite ends thereof. Prong 132 comprises inner catch 132A and outer catch 132B. Prong 134 comprises inner catch 134A and outer catch 134B. To secure snap ring attachment 60 to body 20, prongs 132 and 134 are engaged with holes 29A-B. When fully assembled, catches 132A-B and 134A-B "snap" over respective surfaces 38A-D. For example, catch 134B snaps over surface 38A, catch 134A snaps over surface 38B, catch 132A snaps over surface 38C, and catch 132B snaps over surface 38D, thereby securing clip attachment 60 in body 20 and preventing prongs 134 and 132 from being removed from holes 29B and 29A, respectively. In some embodiments, catch 134B snaps over surface 38D, catch 134A snaps over surface 38C, catch 132A snaps over surface 38B, and catch 132B snaps over surface 38A, thereby securing clip attachment 60 in body 20 and preventing prongs 134 and 132 from being removed from holes 29A and 29B, respectively. In some embodiments, catches 132A-B and 134A-B are elastic. Snap ring 136 generally comprises hook 138, which is secured to arm 130, and deflector 140, which is secured to arm 130. Hook 138 may be fixedly secured, pivotably secured, or hingedly secured to arm 130. Deflector 140 is generally elastic and is displaceable to allow separation between deflector 140 and hook 138 to allow an object (e.g., rope, string, hook, ring, etc.) to engage hook 138. Deflector 140 thereafter returns to its original shape and position to enclose the object within hook 138.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

2 Aerosol canister
4 Stem
10 Case
12 Axis
20 Body
22 Lateral wall
24 Edge
26 Edge
28 Bottom wall
29A Hole
29B Hole
30A Cutout
30B Cutout
30C Cutout
32A Ledge
32B Ledge
32C Ledge
34A Notch
34B Notch
36A Groove
36B Groove
36C Groove
38A Surface

38B Surface
38C Surface
38D Surface
40 Cutout
42 Rib
50 Channel
52 Ring attachment
54 Ring
56 Clip attachment
58 Hole
60 Snap ring attachment
70 Cap
72 Lateral wall
74 Edge
76 Edge
78 Top wall
80 Nozzle
82 Ribs
90A Gusset
90B Gusset
90C Gusset
92A Downwardly projecting protrusion
92B Downwardly projecting protrusion
92C Downwardly projecting protrusion
94 Inlet conduit
96 Hole
98 Outlet conduit
100 Hole
110 Arm
112 Prong
112A Catch
112B Catch
114 Prong
114A Catch
114B Catch
120 Arm
122 Prong
122A Catch
122B Catch
124 Prong
124A Catch
124B Catch
126 Clip
130 Arm
132 Prong
132A Catch
132B Catch
134 Prong
134A Catch
134B Catch
136 Snap ring
138 Hook
140 Deflector
A Arrow
B Position
C Position
AD1 Axial direction
AD2 Axial direction
CD1 Circumferential direction
CD2 Circumferential direction

What is claimed is:

1. A case for securing an aerosol canister, comprising:
a body, including:
a lateral wall having a top edge and a bottom edge; and,
a bottom wall connected to the lateral wall proximate the bottom edge; and,
an attachment means, including:
an arm;
a first prong connected to the arm
a second prong connected to the arm and spaced apart from the first prong; and,
a clip connected to the arm and operatively arranged to abut against the lateral wall and apply a force to the lateral wall.

2. The case as recited in claim 1, wherein the bottom wall further comprises at least one hole.

3. The case as recited in claim 2, wherein the
the first and second prongs are engageable with the at least one hole.

4. The case as recited in claim 1, wherein at least one of the first and second prongs is elastic.

5. The case as recited in claim 1, wherein at least one of the first and second prongs comprises at least one catch which is operatively arranged to engage an inner surface of the body.

6. The case as recited in claim 1, wherein the clip is elastic.

7. The case as recited in claim 1, wherein a hole is formed between the arm and the bottom wall.

8. A case for securing an aerosol canister, comprising:
a body, including:
a lateral wall having a top edge and a bottom edge;
a bottom wall connected to the lateral wall proximate the bottom edge; and,
at least one hole in the bottom wall; and,
an attachment means, including:
an arm;
at least one prong connected to the arm and engageable with the at least one hole; and,
a snap ring, comprising:
a hook connected to the arm; and,
a deflector connected to the arm and engaged with the hook to form a continuous loop.

9. The case as recited in claim 8, wherein the at least one prong comprises at least one catch which is operatively arranged to engage an inner surface of the body.

10. The case as recited in claim 9, wherein the inner surface is adjacent to the at least one hole.

11. The case as recited in claim 8, wherein the attachment means forms a hole between the arm and the bottom wall.

12. The case as recited in claim 11, wherein the attachment means further comprises a ring arranged in the hole.

13. A case for securing an aerosol canister, comprising:
a body, including:
a lateral wall having a top edge and a bottom edge;
a bottom wall connected to the lateral wall proximate the bottom edge, the bottom wall operatively arranged to engage the aerosol canister;
a first hole formed in the bottom wall; and,
a second hole formed in the bottom wall, and,
an attachment means, including:
an arm;
a first prong connected to the arm and operatively arranged to engage the first hole; and,
a second prong connected to the arm and operatively arranged to engage the second hole.

14. The case as recited in claim 13, wherein the second hole is spaced apart from the first hole by a channel.

15. The case as recited in claim 14, wherein a hole is formed between the channel and the arm.

16. The case as recited in claim 13, wherein a hole is formed at least partially by the bottom wall and at least partially by the arm.

17. The case as recited in claim 13, wherein the attachment means further comprises a clip connected to the arm, the clip operatively arranged to abut and bias against the lateral wall.

18. The case as recited in claim 13, wherein the attachment means further comprises a snap ring, the snap ring comprising:

a hook connected to the arm; and, a deflector connected to the arm and engaged with the hook to form a continuous loop.

19. The case as recited in claim 15, wherein the attachment means further comprises a ring arranged in the hole.

20. The case as recited in claim 3, wherein:

the at least one hole comprises a first hole and a second hole, the second hole being spaced apart from the first hole; and, the first and second prongs are engageable with the first and second holes.

* * * * *